US005906018A

United States Patent [19]

Kidwell

[11] Patent Number: 5,906,018

[45] Date of Patent: May 25, 1999

[54] SUNTANNING BODY SUPPORT

[76] Inventor: Donald E. Kidwell, 6023 Ocean Pines, Berlin, Md. 21811

[21] Appl. No.: 08/424,759

[22] Filed: Apr. 18, 1995

[51] Int. Cl.[6] ..... A47C 20/02

[52] U.S. Cl. ..... 5/656; 5/639; 5/632; 5/630

[58] Field of Search ..... 5/639, 632, 633, 5/630, 652, 656, 645, 462; 297/423.41, 452.33, 452.41

[56] References Cited

U.S. PATENT DOCUMENTS

| | | | |
|---|---|---|---|
| 3,323,151 | 6/1967 | Lerman | 5/420 |
| 3,938,205 | 2/1976 | Spann | 5/632 |
| 4,222,468 | 9/1980 | De Fries | 5/431 |
| 4,233,700 | 11/1980 | Spann | 5/632 |
| 4,535,495 | 8/1985 | Oldfield | 5/633 |
| 5,224,226 | 7/1993 | Groenwald | 5/900.5 |
| 5,269,323 | 12/1993 | Krouskop | 5/632 |
| 5,348,523 | 9/1994 | Blount | 5/900.5 |
| 5,396,674 | 3/1995 | Bolds | 5/630 |

*Primary Examiner*—Michael F. Trettel
*Assistant Examiner*—Fredrick Conley

[57] ABSTRACT

An elongate structure has a body support surface inclined with respect to a generally horizontal foundation surface and contoured to provide comfortable support for a sunbather in positions intermediate prone and supine for tanning side portions of the body. A hollow cavity formed in the structure provides a convenient storage and transport compartment and an integral handle facilitates portability.

12 Claims, 3 Drawing Sheets

FIG.7
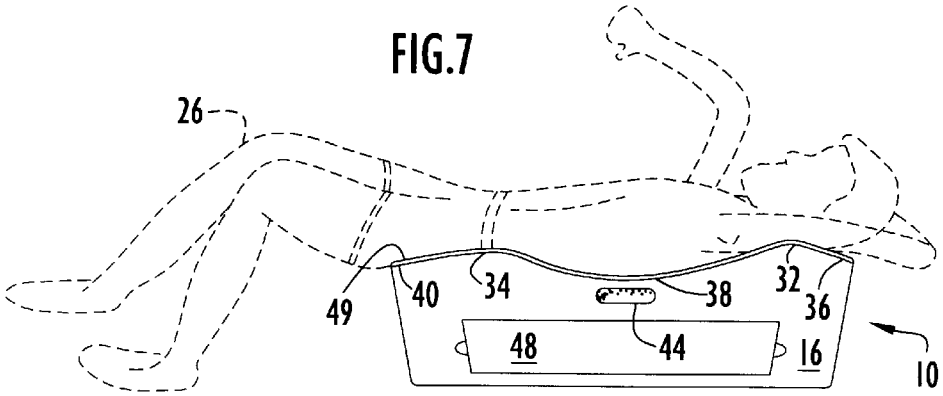
FIG.8
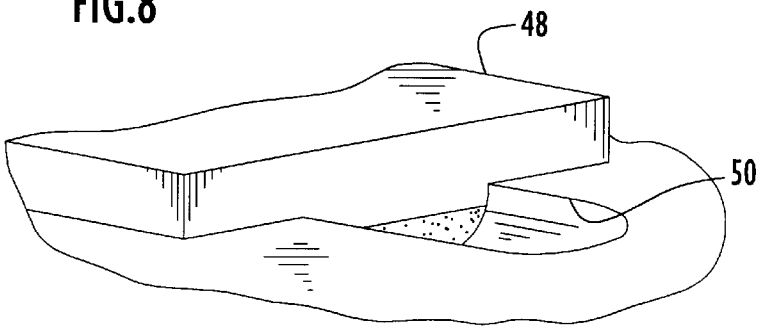
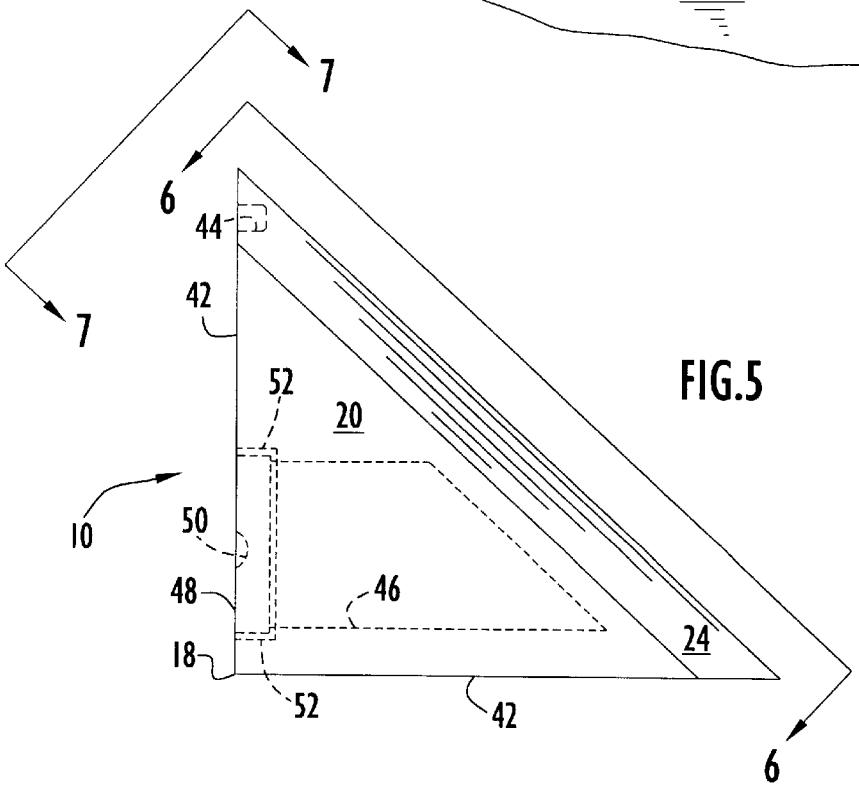
FIG.5

SUNTANNING BODY SUPPORT

BACKGROUND OF THE INVENTION

1. Technical Field

The present invention relates to a body support for suntanning generally and, more particularly, to a cushioned and contoured support for facilitating the acquisition of an even suntan on all sides of the body.

2. Discussion of the Prior Art

Sunbathing is a means to acquire a robust healthy appearance, to socialize and to enhance production of vitamin D. To those seriously searching for the "perfect tan" as well as casual dabblers in the past-time, an annoying and persistent problem has been the difficulty in finding an even moderately comfortable position to expose side surfaces of the body, arms and legs to direct sun's rays. Alternatives heretofore have ranged from accepting wildly uneven two-tone tans featuring attractively bronzed or pigmented backs and fronts delineated by substantially paler stripes of sun-deprived side skin, to spending tedious hours in unattractive and uncomfortable contortions devoted to forcing the body's naturally horizontal surfaces into a sun-absorbing vertical alignment.

SUMMARY OF THE INVENTION

It is therefore an object of the present invention to provide a platform for supporting a sunbather's body in positions that orient side surfaces toward incoming ultraviolet radiation.

It is another object of the present invention to provide a lightweight portable structure to comfortably support a sunbather in a position between prone and supine.

It is a further object of the present invention to provide a support platform ergonomically contoured to provide comfortable uniform support from the head to the lower trunk of a sunbather reclining in a posture intermediate prone and supine.

It is yet another object to provide a suntanning body support structure having a compartment for transporting and storing small items.

The aforesaid objects can be achieved individually and in combination and it is not intended that the invention be construed as requiring that two or more of said objects be combined.

In accordance with the present invention, a wedge shaped structure has a flat base, a back and an angled support surface contoured to conform generally to the portion of the human body between the head and lower torso. A carrying handle and a storage compartment with a removable access panel are formed in the structure.

The above and still further objects, features and advantages of the present invention will become apparent upon considering the following detailed description of specific embodiments thereof, particularly when viewed in conjunction with the accompanying drawings wherein like reference numerals in the various figures are used to designate like components.

BRIEF DESCRIPTION OF THE DRAWINGS

FIG. 5 is a side plan view of the body support of FIG. 3 with a storage compartment shown in phantom.

FIG. 7 is an elevation view taken through lines 7—7 in FIG. 5 with a sunbather shown in phantom.

FIG. 8 is a perspective detail view of an access bevel for removing the access panel.

DESCRIPTION OF THE PREFERRED EMBODIMENTS

Figure 1:
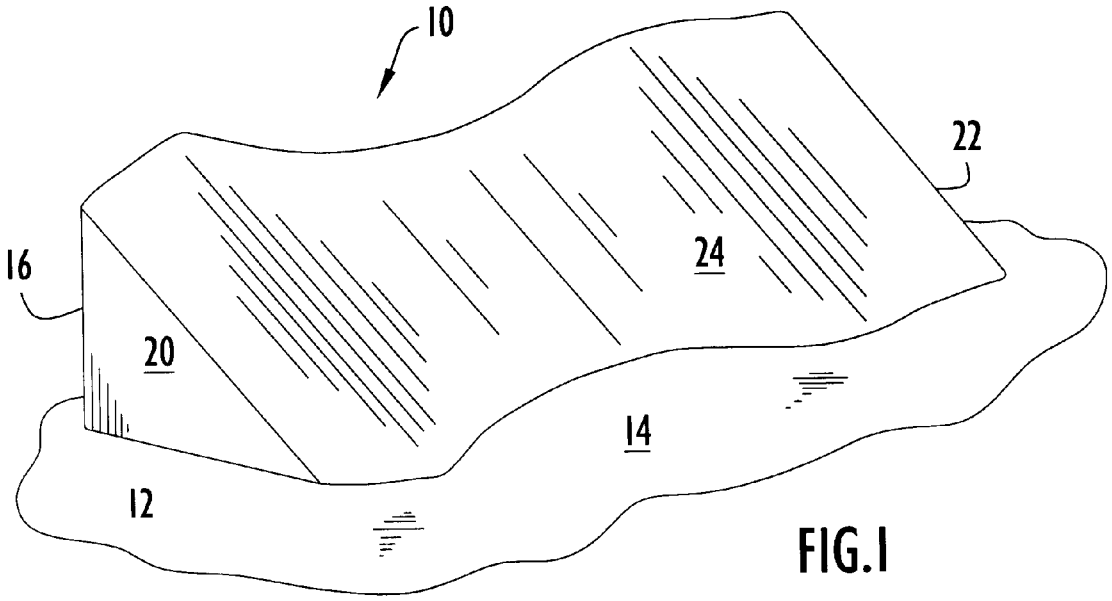
FIG. 1 is a front view in perspective of the suntanning body support according to the present invention.
Figure 2:
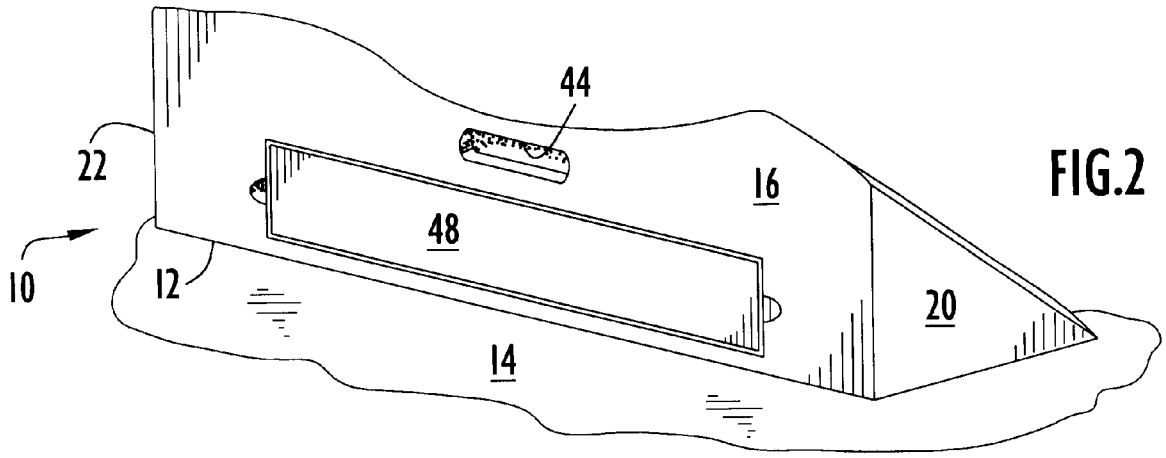
FIG. 2 is a rear view in perspective of the body support of FIG. 1 with the rear access panel in place.

Referring to FIGS. 1–8, a body support for suntanning 10 according to the present invention is an elongate structure, for instance wedge-shaped as illustrated, formed to provide a comfortable back and side rest for a sunbather assuming a position orienting his or her body to tan side portions and constructed to be portable, easily handled and conveniently configured with an enclosable compartment for storing and transporting small items.

The flat bottom, or base, 12 rests on a generally horizontal foundation 14, typically the sand of a beach or the grass or pavement surrounding a pool, but including the platforms or carpeted floors of tanning salons, the decks of ships or boats, or any suitably flat surface. The back 16 of support 10 is flat and forms a perpendicular abutment with the back edge 18 of base 12. Ends 20 and 22 are parallel generally isosceles right triangles, perpendicular to both base 12 and back 16, similar but not necessarily congruent in shape.

A non-planar support surface 24 extends between the ends, base and back completing the generally wedge-shaped body support and forming approximately 45° angles with the base and back. The specific contour of support surface 24 is ergonomically designed to provide comfortable support to the back and sides of a sunbather 26 assuming a posture between the prone and supine positions, particularly the sides of the body and limbs, to allow better orientation with respect to the sun of these typically difficult to tan body portions.

Figure 6:
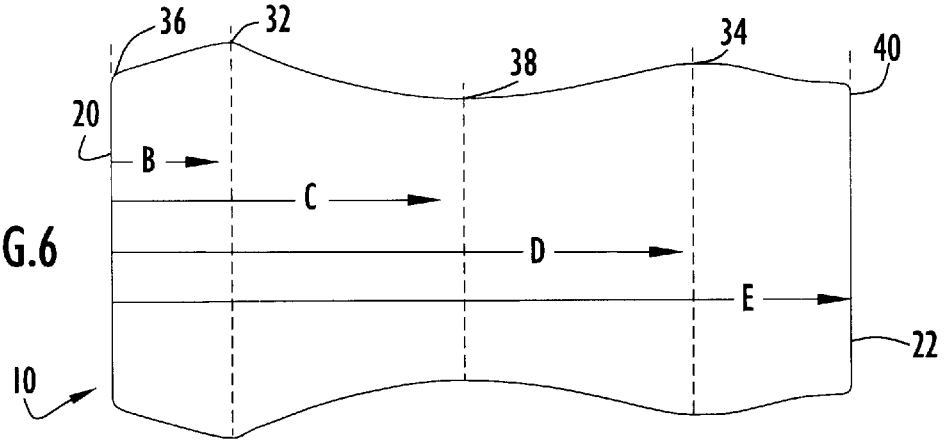
FIG. 6 is an elevation view of the support surface of the body support of FIG. 3 taken through lines 6—6 in FIG. 5.
Figure 3:
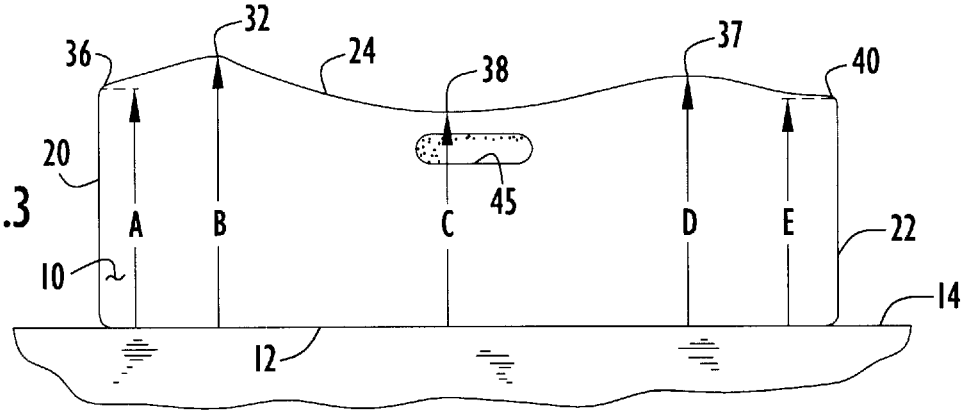
FIG. 3 is a front view in plan of a body support according to the present invention.
Figure 4:
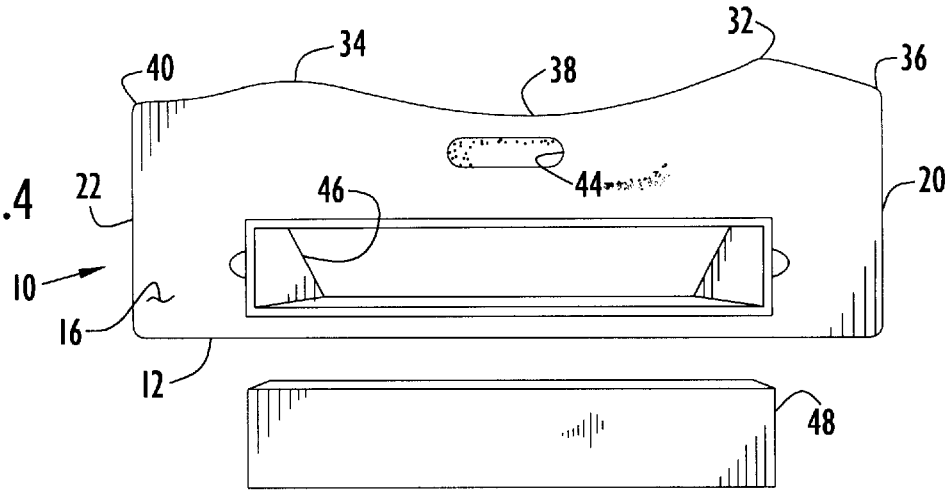
FIG. 4 is a back view in plan of the body support of FIG. 3 and the removed access panel.

As best illustrated in FIGS. 3, 4 and 6, support surface 24 includes first and second expanded sections, or portions, 32 and 34, respectively, enlarged in both width and depth with respect to three more constricted or narrowed sections or portions 36, 38 and 40. As shown in FIG. 7, the first narrowed portion 36, adjacent end 20 supports the sunbather's head. Adjacent expanded portion 32 cradles the small of the neck and the rather long gentle swail of the second narrowed portion 38 is proportioned to correspond to the shape of the back. The second expanded portion 34 rises to support the small of the back or waist and the surface then recedes to the third narrowed portion 40 conforming to and supporting the lower body or buttocks of the sunbather.

The exact dimensions of this contoured support surface can vary with body type and size but a representative set of dimensions found to provide comfortable support for a wide range of users is shown in Table 1. Longitudinal distances are measured from head support end 30 along the structure elongate axis to the maximum or minimum width of each sequentially adjacent support section as designated by lettered arrows shown in FIG. 6, and the contour of support surface 24 at each position is defined by the length of the legs 42 of the isosceles triangular cross-sections, as shown in FIG. 5.

| PORTION | LONGITUDINAL DISTANCE (inches) | CROSS-SECTIONAL WIDTH (inches) |
|---|---|---|
| A: Head | 0.0 | 9.1 |
| B: Neck | 4.2 | 10.7 |
| C: Back | 11.8 | 7.7 |
| D: Small of Back or Waist | 23.0 | 9.8 |
| E: Lower Body or Buttocks | 29.0 | 8.7 |

In addition to varying the depth and separation of the contours of support surface 24, the triangular ends need not have equal length arms, thus the slant or angle assumed by the surface can be varied to values greater or less than 45°, generally between about 30° and 60°, to suit conditions and personal comfort. Moreover, the cross-section of the body support for suntanning need not be specifically triangular, rather any sufficiently strong yet lightweight structure having at least one surface inclined with respect to the foundation and contoured to provide uniform body support would fall within the scope of this invention.

A first slot 44 formed in the back surface 16 and a second slot 45 formed in the bottom or base 12 are proportioned to form carrying handles by which the suntanning body support can be easily grasped for transporting. A hollow compartment 46 is also formed within the structure with access provided by a removable panel 48 cut into the back surface 16. The compartment sides have insets 50 to position and support panel 48 and access indentations 52 beveled into the back surface adjacent the ends of panel 48 to facilitate placement and removal of the panel. Compartment 46 is sized to provide storage for such items as suntan lotion, towels, reading material, beverage containers and dark glasses that are frequently used during tanning sessions.

In one preferred embodiment the body support for suntanning of the present invention is formed of ¾" thick polystyrene foam, or the like, for instance ARCEL™, a copolymer of expanded polystyrene and expanded polyethylene, manufactured by the ARCO Chemical Company. Such a material selection enhances the utility of the storage compartment as an insulated beverage cooler. Alternatively, any sufficiently strong lightweight material, preferably water and sun resistant, can be used as can a solid body with a preformed interior compartment rather than walls. Dependent upon the circumstances and the preferences of the sunbather, the support can be made of rigid, flexible or cushioned material to maximize individual comfort, or may conveniently have cushioning material 49 applied over the rigid contoured support surface, as shown in FIG. 7.

In use, a sunbather loads his or her desired sunbathing accoutrements into compartment 46, secures access panel 48 into insets 50, grasps the body support by a handle 44 or 45, and transports the support to the selected sun session site. The various required notions are removed for handy access and the support is aligned with the elongate axis generally perpendicular to the path of the sun and with the angled support side directed roughly toward the source of radiation. The sunbather then assumes a comfortable posture intermediate prone and supine with a first side of his or her head, neck, back, small of the back or waist and lower torso or buttocks resting against the corresponding portions of the support and the opposite sides exposed to the direct tanning rays. Periodic reversals of the radiated side ultimately produce the desired even tan, equally distributed over all the desired body surfaces.

Having described preferred embodiments of a new and improved body support for suntanning according to the present invention, it is believed that other modifications, variations and changes will be suggested to persons skilled in the art in view of the teachings contained herein and that all such variations, modifications and changes fall within the scope of the present invention as defined by the appended claims.

What is claimed is:

1. A suntanning body support for comfortably supporting the body of a sunbather in positions intermediate prone and supine comprising an elongate structure configured to rest on a generally planar foundation surface, said structure having at least one body support surface formed thereon, said at least one body support surface being inclined with respect to said planar foundation, said at least one body support surface having contours formed therein conforming to the contours of the body of the sunbather, said at least one body support surface having a hollow storage compartment formed within said elongate structure.

2. The suntanning body support of claim 1 further comprising a removable panel formed in said back of said structure for providing access to said compartment.

3. The suntanning body support of claim 1 further comprising at least one slot formed in said elongate structure forming a carrying handle.

4. The suntanning body support of claim 1 further comprising cushioning attached along said body support surface.

5. The suntanning body support of claim 1 wherein said elongate structure is wedge-shaped having a base, a back, and an inclined contoured support surface extending generally along the elongate axis and a first and a second triangular end extending generally perpendicular said elongate axis.

6. A body support for use by a sunbather in comfortably positioning his/her body on a foundation surface in positions intermediate prone and supine, said body support comprising:

a base member having a bottom surface adapted to rest on said support surface;

a back member abutting said base member along a common edge of said base and back members;

a support member having a support surface and opposite first and second longitudinal edges joined to said back and base members, respectively, said support surface having contours to match the contours of the body of said sunbather;

wherein, said support surface is oriented such that, when the bottom surface of said base member rests on said foundation surface, said support surface is inclined relative to said foundation surface to permit said sunbather, lying on said foundation surface in a position between prone and supine, to have said contours of his/her body resting on corresponding contours of said support surface.

7. The body support of claim 6 wherein said support surface is inclined at an angle in the range of 30° to 60° with respect to said foundation surface when the bottom surface of said base member rests on said support surface.

8. The body support of claim 6 wherein the contours of said support surface include sequentially adjacent portions dimensioned to conform to the head, neck, back, waist and buttocks of the sunbather.

9. The body support of claim 6 wherein said support surface has, in adjacent order, a narrowed portion at a first end, a first expanded portion, a second narrowed portion, a second expanded portion and a third narrowed portion located at a second end, said portions being dimensioned to conform generally to the head, neck, back, waist and buttocks, respectively of the sunbather.

10. A suntanning body support for comfortably supporting the body of a sunbather in positions intermediate prone and supine comprising:

an elongate structure configured to rest on a generally planar foundation surface, said structure having at least one body support surface formed thereon, said at least one body support surface being inclined with respect to said planar foundation surface, said at least one body support surface having contours formed therein conforming to the contours of the body of the sunbather;

wherein said elongate structure is wedge shaped having a base, a back and an inclined contoured support surface extending generally along the elongate axis, and a first and second triangular ends extending generally perpendicular to said elongate axis;

wherein said contoured surface is inclined at an angle in the range of 30° to 60° with respect to said base;

wherein said inclined contoured surface has, in adjacent order, a narrowed portion at said first end, a first expanded portion, a second narrowed portion, a second expanded portion and a third narrowed portion located at said second end, said portions being dimensioned to conform generally to the head, neck, back, waist and buttocks, respectively of the sunbather; and wherein said contoured surface is disposed such that, the sunbather, lying in a position intermediate prone and supine on said foundation surface, can rest his/her back comfortably on said support surface with his/her head, neck, back, waist and buttocks resting on respective portions of said support surface.

11. The body support of claim 10 wherein the cross-sections of said elongate wedge structure are isosceles right triangles with equal length sides, and the contoured portions are characterized by distances measured along the elongate axis from said first end and corresponding cross-sectional triangular side lengths.

12. The body support of claim 11 wherein said first narrowed portion has cross-section side lengths of 9.1 inches at an elongate distance from said first end of 0.0 inches, said first expanded portion has side lengths of 10.7 inches at an elongate distance of 4.2 inches from said first end, said second narrowed portion has side lengths of 7.7 inches at an elongate distance of 11.8 inches, said second expanded portion has side lengths of 9.8 inches at an elongate distance of 23.0 inches, and said third narrowed portion has side lengths of 8.7 inches at an elongate distance of 29.0 inches.

* * * * *